US006039196A

United States Patent [19]

Ekkert et al.

[11] Patent Number: 6,039,196

[45] Date of Patent: Mar. 21, 2000

[54] TAMPER INDICATING CHILD-RESISTANT CLOSURE

[75] Inventors: Len Ekkert, Naperville; Albert R. Miller, Hinsdale; Bridgett Zemlo, West Chicago, all of Ill.

[73] Assignee: Phoenix Closures, INc., Naperville, Ill.

[21] Appl. No.: 09/107,601

[22] Filed: Jun. 30, 1998

[51] Int. Cl.[7] ..... B65D 41/34; B65D 55/02

[52] U.S. Cl. ..... 215/216; 215/221; 215/250

[58] Field of Search ..... 215/216, 217, 215/218, 219, 220, 221, 256, 330, 250, 251

[56] References Cited

U.S. PATENT DOCUMENTS

| | | | |
|---|---|---|---|
| 3,980,195 | 9/1976 | Fillmore | 215/256 |
| 4,345,690 | 8/1982 | Hopley | 215/216 |
| 4,449,639 | 5/1984 | Davis | 215/224 |
| 4,511,051 | 4/1985 | Desai | 215/216 |
| 4,752,013 | 6/1988 | Miller et al. | 215/216 |
| 5,165,559 | 11/1992 | Kusz | 215/216 |
| 5,460,281 | 10/1995 | Rapchak et al. | 215/216 |
| 5,638,969 | 6/1997 | King | 215/216 |
| 5,706,963 | 1/1998 | Gargione | 215/219 |
| 5,727,703 | 3/1998 | Fuchs | 215/214 |

FOREIGN PATENT DOCUMENTS

| | | | |
|---|---|---|---|
| 25 33 230 | 2/1977 | Germany | 215/216 |

*Primary Examiner*—Allan N. Shoap
*Assistant Examiner*—Rodrigo L Eichwald
*Attorney, Agent, or Firm*—Welsh & Katz, Ltd.

[57] ABSTRACT

A child resistant closure is used with an associated container. The closures includes a closure cap having a circular top wall portion and a depending annular skirt portion. The skirt portion has an edge region spaced from the top wall portion. The cap includes at least one pivotal release tab extending from the skirt portion and connected thereto by a connector. The connector extends between the tab and the skirt portion at about the edge region. The tab further includes a ratchet extending therefrom to engage the container. The closure is removed from the container by urging the release tab inwardly of the closure to disengage the ratchet from the container. The closure can include a tear away tamper-evident band overlying the release tab to provide visibly discernible evidence that the closure has been removed from the container.

13 Claims, 4 Drawing Sheets

TAMPER INDICATING CHILD-RESISTANT CLOSURE

FIELD OF THE INVENTION

This invention relates to a child-resistant tamper indicating closure. More particularly, the invention relates to a hinged-tab childproof closure having a tear-away tamper-indicating band.

BACKGROUND OF THE INVENTION

Container closures, and more specifically, tamper-indicating or tamper-evident closures are well known in the art. In addition, a wide variety of such closures are designed to prevent unwanted opening of the container by, for example, a child. Such closures are commonly referred to as childproof or child-resistant closures.

Some childproof closures include a locking mechanism that requires pressure to be applied to the closure at specific locations to release the closure form the container. In one known form, the closure includes hinged tabs that lock into or engage slots in a portion of the container. The tabs are hinged such that pressure is applied to the tabs at about the top of the closure, e.g., at about a location where the tabs are adjacent to the top wall of the closure. In another known closure, the child-proof feature is provided by one or more detents that are located at about the lower edge of the closure skirt that engage a complementary detents that are formed in the container. The detents are disengaged from one another by applying pressure at about a lower portion of the skirt to separate and thus release the detents from one another.

In one known arrangement, tamper indication is provided by a separable band that extends and depends from the skirt portion. The band engages a locking ring or a locking lug that is formed on the container. The band or lug prevents removal of the closure without first removing the band, or facilitates separating the band from the skirt portion as the closure is removed from the container. Other known tamper-indicating arrangements include skirts having breakable or break-away sections formed as part of the skirt wall and depending break-away tabs.

Although such known tamper-indicating, child-proof closures function well for their intended purposes, there are a number of drawbacks. First, manufacturing such closures can be difficult, given the amount of "tooling" that may be required for a particular design. This is particularly true for those closures having portions of the skirt wall that break away from the skirt body. Moreover, it has been observed that removal of closures that require a significant amount of pressure applied to the skirt lower portion can be difficult for persons that have limited mobility of their fingers.

Accordingly, there continues to be a need for a closure that includes child-resistant and tamper-indicating features. Such a closure has a readily removable tamper-indicating band and closure band in which the band remains intact with the closure cap skirt portion as the closure is initially applied to the container, and in which the band separates from the closure cap upon disengaging the closure from the container.

SUMMARY OF THE INVENTION

A child resistant closure for use with an associated container, the container having a finish with an interference member extending therefrom, includes a circular top wall portion and a depending annular skirt portion. The skirt portion has an edge region spaced from the top wall portion. The closure cap includes at least one pivotal release tab extending from the skirt portion. The release tab is spaced from and connected to the skirt portion by a flexible connector or hinge. The connector extends between the tab and the skirt portion proximal to the edge region. The tab further includes an interfering projection or ratchet extending inwardly therefrom. The tab is pivotal between an engaged position wherein the ratchet engages the container interference member when the closure is engaged with the container to maintain the closure thereon. The release tab pivots to a disengaged position wherein the ratchet disengages the container interference member to remove the closure from the container.

In one embodiment of the closure, the tab pivots about an axis that is generally parallel to a longitudinal axis of the closure. In an alternate embodiment of the closure, the tab pivots about an axis that is generally transverse to the closure axis.

The closure can include a tear-away tamper-indicating band connected to the skirt portion at about the end region. The tamper-indicating band is connected to the skirt portion by a plurality of frangible connectors. The tear away band is connected to the closure and positioned in overlapping relation to the release tabs and indicates removal of the closure from the container.

In a preferred embodiment, the closure includes two release tabs positioned 180° relative to one another. Most preferably, the tear away band includes a tab or grasping region to facilitate removing the band from the closure. The tear away band can further include a plurality of inwardly projecting, angled members to engage the closure, to further prevent unwanted rotation of the closure relative to the container.

Other features and advantages of the present invention will be apparent from the following detailed description, the accompanying drawings, and the appended claims.

DETAILED DESCRIPTION OF THE PREFERRED EMBODIMENTS

Figure 1:
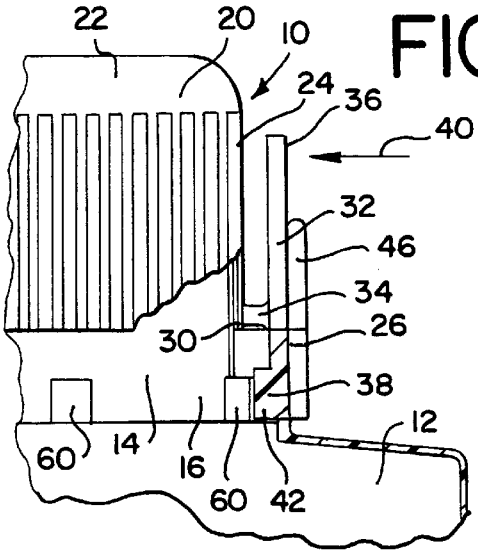
FIG. 1 is a partial side view of one embodiment of a tamper-indicating, child-resistant closure embodying the principles of the present invention, the closure being oriented to illustrate the relative positioning of the release tab and tamper indicating band opposingly positioned on the closure.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures, and particularly, to FIG. 1, there is shown one embodiment of a container closure 10 in accordance with the principles of the present invention. The closure 10 is shown with an associated container 12 to which the closure 10 is fitted. The container 12 includes a finish portion 14, which is that portion of the container 12 that includes the container neck 16 and that portion of the container 12 to which the closure 10 is engaged.

The container finish includes an external thread formation 18 thereon for threadedly engaging the closure. The finish 14, as will be described in more detail herein, can include any one of a number of configurations for engaging the closure.

The closure 10 includes a closure cap 20 having a circular top wall portion 22 and a depending annular skirt portion 24 depending from the top wall portion 22. A tear-away tamper-evident band 26 is connected to the skirt portion 24. The band 26 is configured to provide visibly discernable evidence that the closure 10 has been removed from the container 12, that the container 12 may have been opened or that the contents may have been otherwise tampered with. The skirt portion 24 includes a thread formation (not shown) on an inner surface thereof. The thread is configured to threadedly engage the container finish thread 18 for applying the closure 10 to the container 12. The closure 10 can include a circumferential seal-retaining ring (not shown) therein to facilitate retaining a seal or like member to provide a leak-proof seal between the container 12 and the cap 20.

It will be recognized by those skilled in the art that although the present closure 10 is described in use with a threaded-type container, the cap 10 can be used with other container 12 configurations such as snap-type or ratchet-type container closures.

Figure 3:
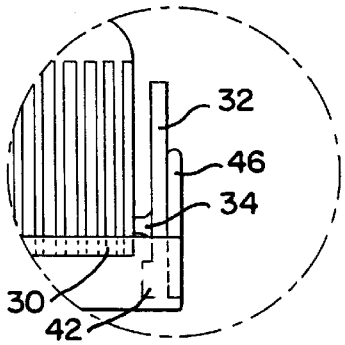
FIG. 3 is an enlarged side view of the area of one closure shown on FIG. 1.
Figure 2:
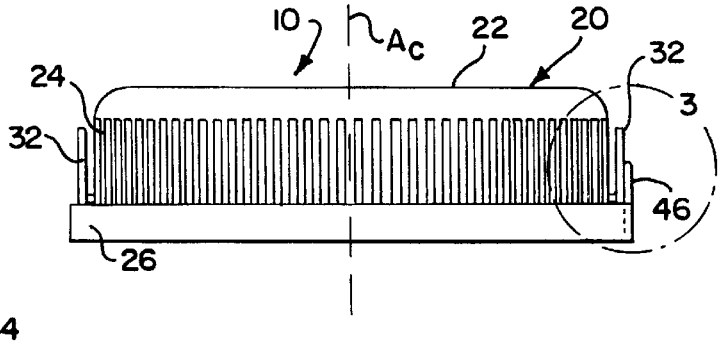
FIG. 2 is a side view of the closure shown in FIG. 1.
Figure 6:
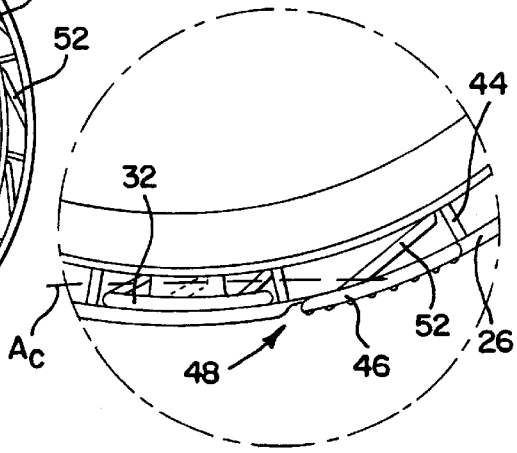
FIG. 6 is an enlarged view of the area of the closure also shown in FIG. 4, illustrating a connector portion of the tear away band.
Figure 7:
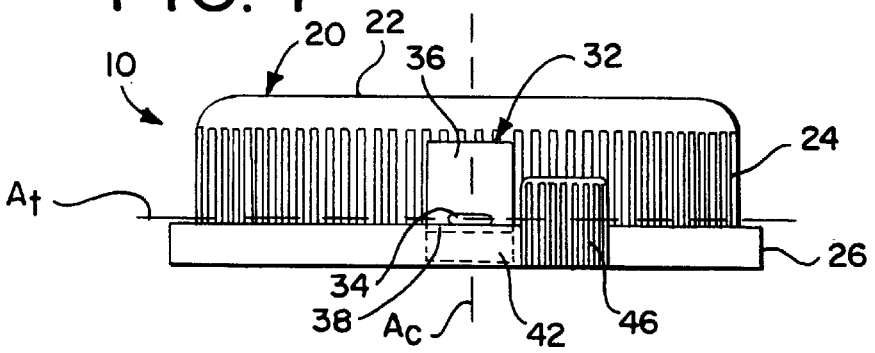
FIG. 7 is a side view of the closure illustrated in FIG. 2, rotated 90° therefrom to show the release tab and tear away band tab.

Referring now to FIGS. 1 and 3, the skirt portion 24 includes an edge region 30 thereon spaced from the top wall 22. A pivotal release tab 32 extends outwardly from the skirt portion 24 generally parallel the skirt 24. The release tab 32 is connected to the skirt portion 24 at about the edge region 30 by a flexible connector or hinge 34. As can be seen from the figures, the hinge 34 is connected to the release tab 32 intermediate the top and bottom of the tab, 36, 38, respectively. The connector 34 is configured to permit the release tab 32 to pivot thereabout, by applying inward pressure on the tab 32 as indicated at 40. The tab 32 pivots about an axis $A_t$ (FIGS. 6–7) that is generally transverse to an axis $A_c$ of the closure 10. The hinge 34 can be formed as a point-like connection extending between the tab 32 and the skirt 24. Alternately, the hinge 34 can be formed as a continuous line-like connection or a series of line-like or point-like connections extending between the tab 32 and the skirt 24.

As will be apparent from the figures, inward pressure on the release tab 32 results in the tab bottom 38 being urged outwardly, away from the skirt portion 34. The release tab 32 includes container finish engaging element, such as the exemplary ratchet 42, extending inwardly therefrom at about the tab bottom 38. As will be described in more detail herein, the ratchet 42 is configured to engage an interference member, such as the illustrated ratchet elements 60 that are positioned on the container finish 14.

In a preferred embodiment, the closure 10 includes two release tabs 32 that are circumferentially, opposingly oriented relative to one another. That is, the release tabs 32 are positioned 180° from one another. In a most preferred embodiment, the release tabs 32 extend beyond the edge region 30 of the cap 20. The release tabs 32 with the ratchet 42 extending therefrom engage the container 12 to maintain the closure 10 on the container 12, and further serve as a child protective feature. The closure 10 is readily removed from the container 12 by depressing the tab top portions 36 which in turn urge the tab bottom portions 38 including the ratchets 42 outwardly, disengaging the closure cap 20 from the container 12.

As will be readily apparent from the figures, various design aspects of the closure 10 must be considered as they relate to the tab/ratchet (32/42) to container 12 engagement. In particular, the tab 32 must be configured such that the bottom portion 38 pivots sufficiently away from the container 12 so that the ratchet 42 fully clears or disengages from the container 12.

Tab 32 or ratchet 42 clearance from the container 12 can be accomplished using a variety of configurations. For example, with the hinge 34 positioned near or proximal to the skirt edge region 30, the tab top portion 36 can be shortened, which, in effect, permits a greater pivot angle of the bottom portion 38 relative to the skirt 24. Alternately, the length of the tab bottom portion 38 can be increased which, although not increasing the pivot angle, increases the distance between the ratchet 42 and the skirt 24 when the tab 32 is fully pivoted. Other configurations for providing sufficient clearance of the tab 32 from the container 12 will be recognized by those skilled in the art.

In conjunction with the tab/container (32/12) engagement and disengagement considerations, the ability of the closure 10 to provide child-resistant features is also to be considered. The child-resistant features can be accomplished by, for example, requiring deliberate pressure to be applied to the tab top portion 36 in order to remove the closure 10 from the container 12. Alternately, the child-resistant feature can be accomplished by shortening the tab top portion 36, which in turn increases the amount of pressure that must be applied to depress the tabs 32 to clear the container 12. Other methods by which the child-resistant feature can be accomplished will be recognized by those skilled in the art.

The closure 10 can further include a tamper-evident band such as the illustrated tear-away type band 26. As shown in FIGS. 1–6, the tear-away band 26 extends outwardly from the skirt portion 24, and overlies or overlaps the release tabs 32. The tear-away band 26 is connected to the skirt portion 24 by a plurality of circumferentially spaced, frangible bridge-like connectors 44 extending between the skirt 24 and the band 26. The band 26 can include a tab or like gripping member 46 to facilitate removing the band 26 from the closure 10. Preferably, as illustrated in FIG. 6, the tab 46 is connected to the band 26 at a tear-away region 48 by a frangible connector 50, that is readily broken to facilitate removing the tear-away band 26 from the closure 10. In a current embodiment, the closure 10 includes a larger connector 56 extending between the band 26 and the skirt portion 24. The larger connector 56 remains intact after the closure 10 is removed from the container 12, so that the band 26 remains connected to the closure 10. In a most preferred embodiment, the tear-away band 26 includes a plurality of angled, wing-like elements 52 extending inwardly therefrom that engage the container 12 to prevent turning or rotating the closure 10 relative to the container 12.

Figure 5:
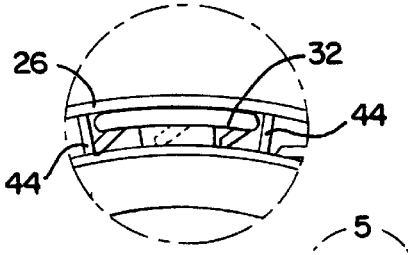
FIG. 5 is an enlarged view of the area of the closure shown in FIG. 4.
Figure 4:
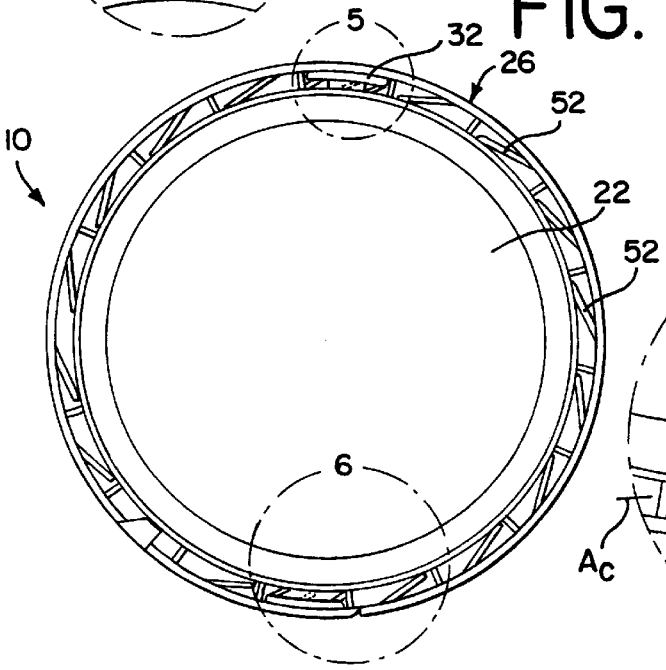
FIG. 4 is a top view of the closure of FIG. 1 illustrating the relative positioning of the release tabs and the tear away band.

As best seen in FIGS. 3 and 5, the tear-away band 26 overlies the closure release tabs 32. This configuration provides added assurance that the closure 10 has not been removed from the container 12 prior to initial use. In this configuration, with the tear-away band 26 overlying the release tabs 32, the release tabs 32 cannot be pivoted because outward movement of the tab bottom portion 38 is prevented by contact with the tear-away band 26.

Figure 8:
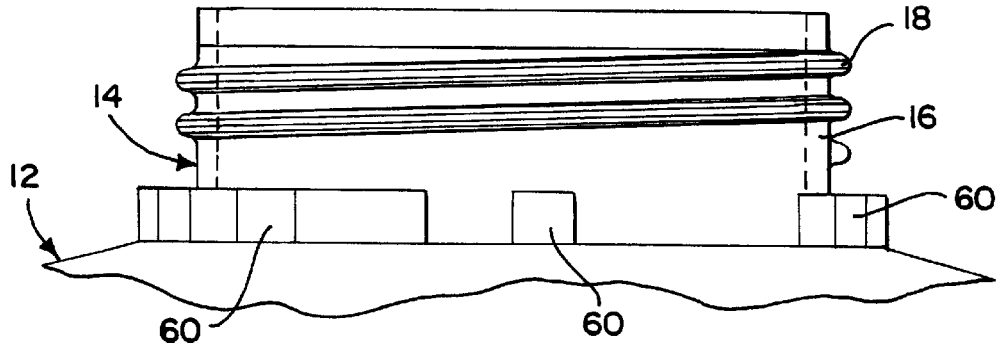
FIG. 8 is a side view of an exemplary container that is used with the is closure of the present invention.
Figure 9:
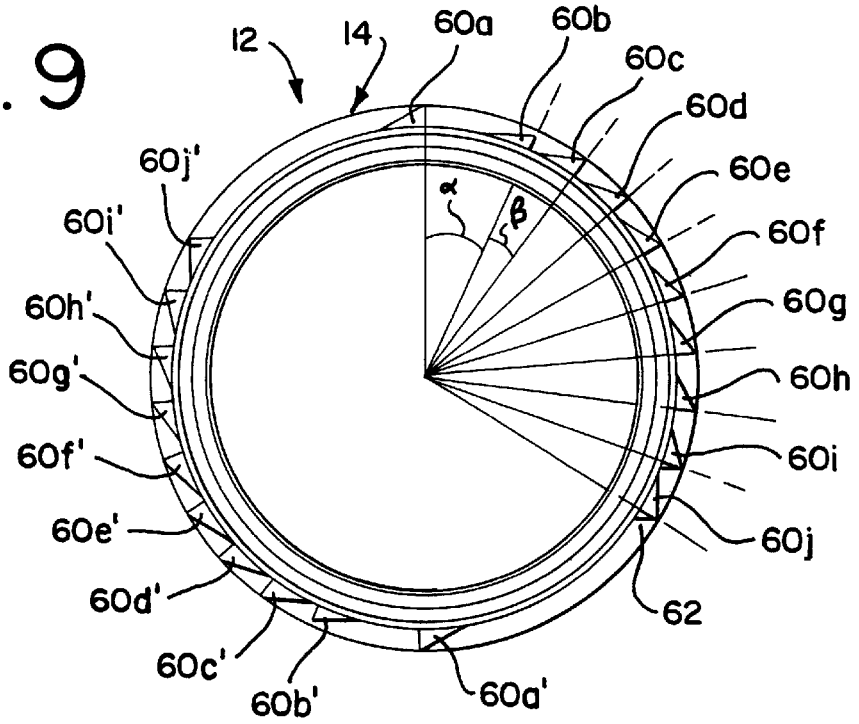
FIG. 9 is a top view of the container of FIG. 8 showing the ratchet elements positioned on the container finish.

A preferred container finish 14 for use with the present closure 10 is illustrated in FIGS. 8 and 9. The container finish 14 includes a plurality of engaging elements such as the ratchet-like elements 60 extending outwardly from the neck 16 that engage both the release tabs 32 and the angled, wing-like elements 52 positioned on the tear-away band 26. Referring to FIG. 9, it can seen that the ratchet elements 60 are not equally circumferentially spaced from one another. The elements 60 can, however, be positioned symmetrical relative to one another about a line, as indicated at 62, extending across a diameter of the container finish 14.

In a present embodiment, the ratchet elements 60 are so positioned to facilitate manufacturing the containers 12 in accordance with known blow-molding techniques. Ratchets 60 are configured so that the container can be readily removed from the mold after it is formed, without interference from the ratchet members 60 engaging the mold. Referring to FIG. 9, a first, single ratchet member 60*a* (having a mirror image member 60*a*' 180° therefrom) is positioned at an angle $\alpha$ of about 24° from the next closest ratchet member 60*b*, 60*b*'. Ratchet members 60*c* . . . 60*j* and 60*c*' . . . 60*j*' are then positioned at an equal circumferential angle $\beta$ relative to one another of about 12°. As can be seen from, for example element 60*j*, the engaging surfaces 62 of the elements 60 are incrementally rotated from the first element 60*a* through the last element 60*j*. This incremental rotation further facilitates removing the container 12 from the blow mold apparatus.

Figure 10:
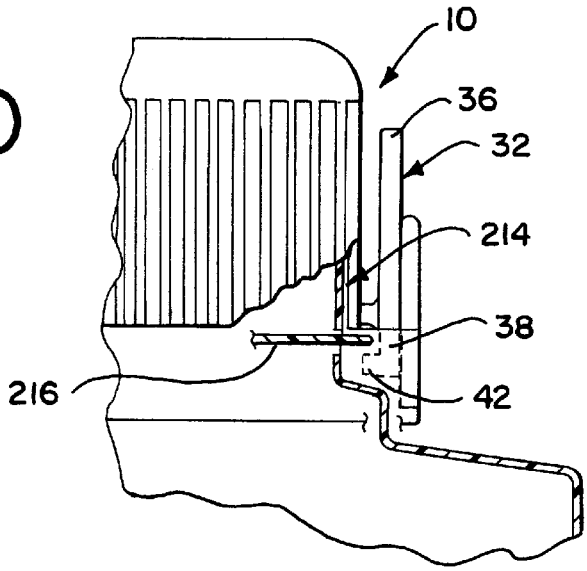
FIG. 10 is an illustration of an alternate embodiment of a container finish that can be used with the closure of the present invention.

An alternate embodiment of the container finish 214 having a closure 10 positioned thereon is illustrated in FIG. 10. In the alternate container finish 214, an interference ring 116 extends outwardly from the container 10 to engage the release tabs 32. The interference ring 216 can be configured as a continuous ring extending circumferentially about the container finish 214 or can be configured as a plurality of discrete ring portions, so long as any space between the ring portions is smaller than the length of the release tab 32 (as indicated at 54 in FIG. 7). As with the embodiment 14, this embodiment of the container finish 214 and closure 10 can be used with threaded-type closures, as well as snap-type and bayonet-type closures.

Figure 11:
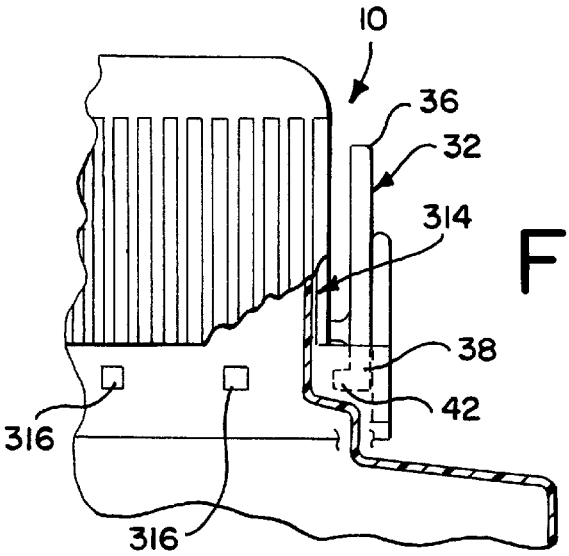
FIG. 11 is an illustration of yet another alternate embodiment of a container finish that can be used with the present closure.
Figure 12:
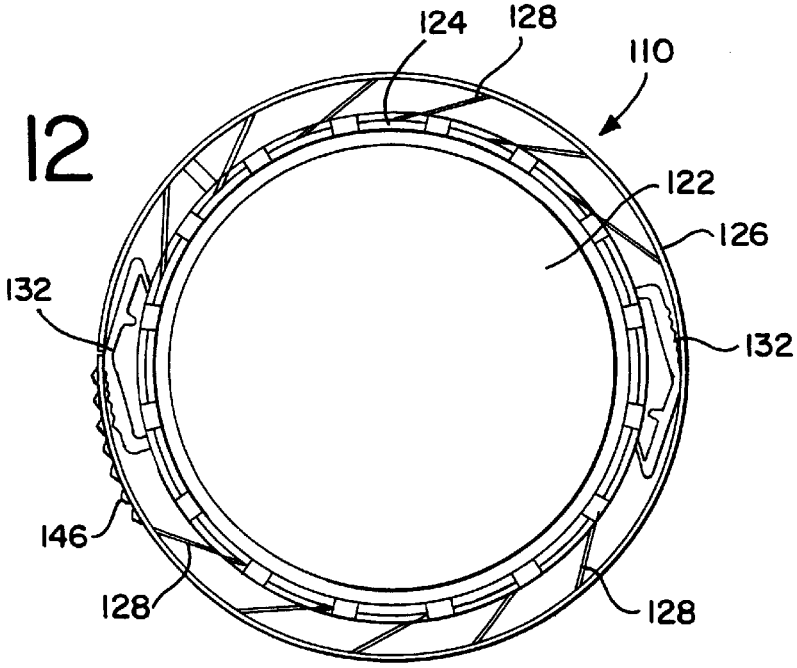
FIG. 12 is a top view of an alternate embodiment of a tamper-indicating, child-resistant closure in accordance with the principles of the present invention the closure being illustrated without the container for clarity of illustration.

Another alternate embodiment of the container finish 314 is illustrated in FIG. 11. In this embodiment, the container finish 314 includes a plurality of outwardly extending projections 316 that interfere with the closure 10 as it is rotated from the container 12. In this configuration, as with the above-described configurations, in order to release the closure 10 from the container 12, the release tabs 32 must be urged inwardly at about the tab upper portion 36 so that the closure 10 can freely rotate off of the container 12. As will be apparent from this description, the embodiment 314 illustrated in FIG. 11 can be used with closures 10 that rotate, at least in part, onto and off of the container 12, such as threaded engagements and bayonet-type engagements.

Those skilled in the art will recognize that regardless of which container finish 14, 214, 314 is used, the closure 10—container 12 engagement arrangement must be configured so that the tabs 32 can be readily cleared from the container engagement elements when it is desired to remove the closure 10 from the container 12.

An alternate embodiment of the closure 110 is illustrated in FIGS. 12–15. This embodiment of the closure 110 includes a cap 120 having a top wall portion 122 and a depending skirt portion 124. A tear-away tamper-evident band 126 is connected to the skirt portion 124 by a plurality of frangible, bridge-like connectors 144 that extend between the skirt 124 and the band 126. The band 126 can include a tab or like gripping member 146 to facilitate removing the band 126 from the closure 110.

Figure 14:
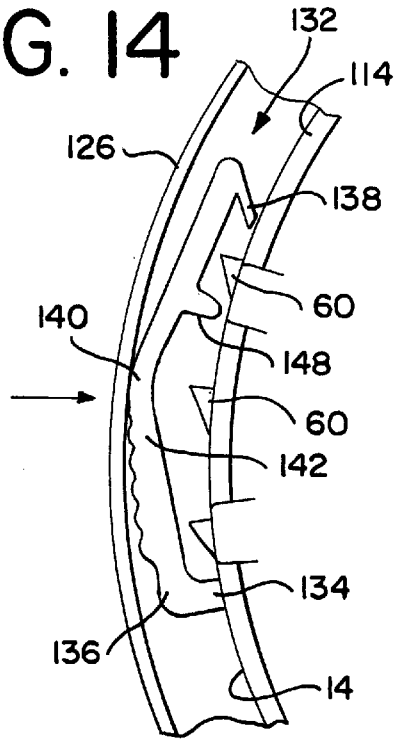
FIG. 14 is an enlarged view of the closure of FIG. 12, illustrating the release tab in the locked or engaged position, and shown with the tamper-indicating band in place on the closure, the container ratchet elements being shown in phantom lines.
Figure 15:
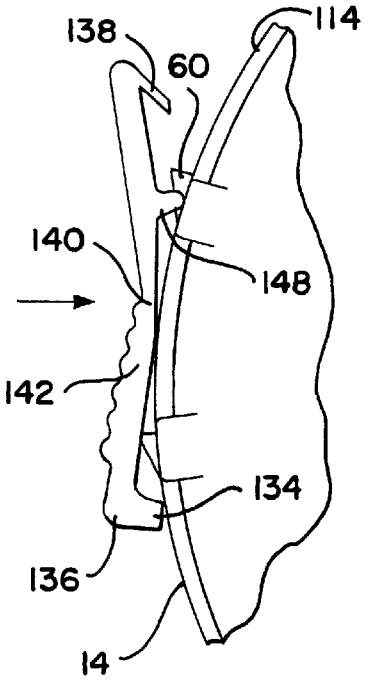
FIG. 15 is a view similar to FIG. 14, with the tamper-indicating band removed and showing the release tab in the released or disengaged position the container ratchet elements being shown in phantom lines.

A flexible release tab 132 is connected to the skirt portion 124 at about the edge region 130 thereof by a flexible connector or hinge 134. Referring now to FIGS. 14–15, the hinge 134 is connected to the skirt portion 124 at about an end 136 of the tab 132. A ratchet 138 is formed in the tab 132 at an end generally opposing the hinge 134. The tab 132 is sufficiently flexible so that depressing the tab 132 inwardly at about a midpoint thereof as indicated at 140, flexes the central portion 142 of the tab 132 inwardly, urging a pivot portion 148 of the tab 132 against the closure 210. Inward urging of the pivot portion 148 produces a cantilever effect that, in turn, moves the ratchet 138 outwardly, out of engagement with the container ratchet elements 60. As best seen in FIGS. 14 and 15, the pivot portion 148 is formed as part of the tab 132, and is thus formed in spaced relation to the closure skirt 114.

Figure 16:
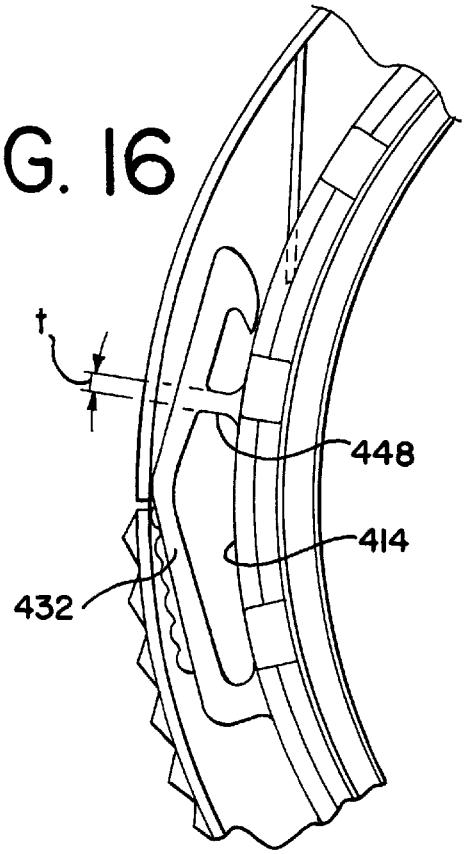
FIG. 16 is an enlarged view of yet another embodiment of the tamper-indicating, child-resistant closure in accordance with the principles of the present invention.

Alternately, as illustrated in FIG. 16, the pivot portion 448 can be formed as part of, connected to or integral with the skirt 414 and the tab 432, such that the pivot 448 bridges the skirt 414 and tab 432. In a current embodiment, the pivot portion 448 is formed as a relatively thin element extending between the skirt 414 and tab 432, and has a thickness t of between about 0.025 inches and about 0.050 inches (about 25 mils to about 5 mils). As will be recognized by those skilled in the art, the bridging pivot portion 448 must be sufficiently thin to permit it to flex when the tab 432 is depressed, while it must be sufficiently strong to prevent inadvertent breakage.

Figure 13:
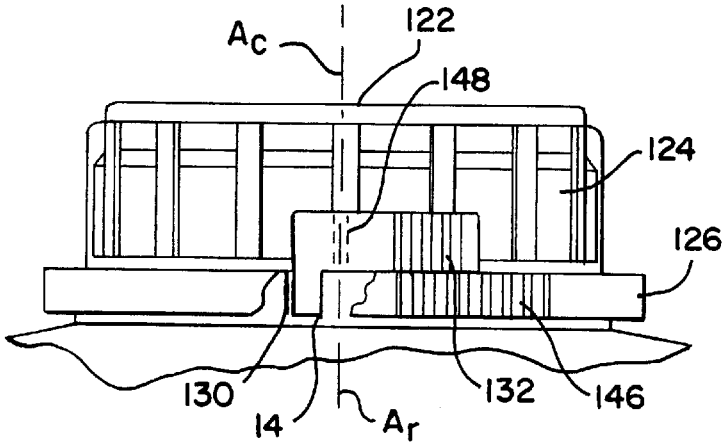
FIG. 13 is a side view of the closure of FIG. 12, illustrated with a part of the tamper band removed for clarity of illustration of the release tab.

As will be apparent from the figures, and particularly FIGS. 13–15, in this embodiment of the closure 10, the release tab 132 pivots about an axis $A_r$ that is generally parallel to the central axis $A_c$ of the closure 110. As will also be apparent from the figures, the ratchet 138 is displaced longitudinally from the release tab 132, generally depending therefrom, much like the tamper-evident band 126.

The band 126 can be positioned on the closure 10 to overlie or overlap the release tab 132, and specifically the ratchet portion 138 of the tab 132 so that the tab 132 is limited in movement and is thus prevented from pivoting because outward movement of the ratchet portion 138 is restricted by contact with the band 126. It will be recognized by those skilled in the art that this embodiment of the closure 110 functions when used with the container finish 14, as well as with alternate container finishes 214, 314.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A child resistant closure for use with an associated container, the container having a finish having an interference member extending therefrom, the closure comprising:

a circular top wall portion, and an annular skirt portion depending from said top wall portion, said skirt portion having an edge region spaced from said top wall portion, said closure defining a longitudinal axis therethrough;

at least one pivotal release tab extending from said skirt portion, said release tab being pivotal about an axis that is generally perpendicular to said closure longitudinal axis, said at least one release tab having a container engaging element and being spaced from and connected to said skirt portion by a hinge, said hinge extending between said tab and said skirt portion proximal to said edge region, said at least one tab being pivotable between an engaged position wherein said container engaging element engages the container interference member when said closure is engaged with the container to maintain the closure thereon, and a disengaged position wherein said container engaging element disengages from the container interference member to remove said closure from the container; and a tamper-indicating band connected to said skirt portion at about said end region by a plurality of frangible connectors, said band being connected to said closure and positioned in overlapping relation to at least a portion of said at least one tab to limit pivoting of said at least one tab when said tamper-indicating bands is connected to said skirt portion and overlying said portion of said at least one tab, said band being removable from said closure to permit pivoting said at least one tab and to permit removal of said closure from the container.

2. The child resistant closure in accordance with claim 1 including two release tabs, said tabs being circumferentially, opposingly oriented relative to one another.

3. The child resistant closure in accordance with claim I wherein said container engaging element extends beyond a plane perpendicular to an axis of said closure defined by said edge region.

4. The child resistant closure in accordance with claim 1 wherein container engaging element is a ratchet.

5. The child resistant closure in accordance with claim 1 wherein said closure includes a pivot portion integral with said release tab, said pivot portion defining said release tab pivoting axis.

6. The child resistant closure in accordance with claim 5 wherein said pivot portion is integral with said release tab.

7. The child resistant closure in accordance with claim 6 wherein said pivot portion is integral with said annular skirt portion.

8. A child resistant closure for use with an associated container, the container having a finish having an interference member extending therefrom, the closure comprising:

a circular top wall portion, and an annular skirt portion depending from said top wall portion, said skirt portion having an edge region spaced from said top wall portion, said closure defining a longitudinal axis therethrough;

at least one pivotal release tab extending from said skirt portion, said release tab being pivotal about an axis that is parallel to and spaced from said closure longitudinal axis, said at least one release tab having a container engaging element and being spaced from and connected to said skirt portion by a flexible connector, said connector extending between said at least one tab and said skirt portion proximal to said edge region, said at least one tab extending beyond said end region away from said top wall and being pivotable between an engaged position wherein said container engaging element engages the container interference member when said closure is engaged with the container to maintain the closure thereon, and a disengaged position wherein said container engaging element disengages from the container interference member to remove said closure from the container; and a tamper-indicating band connected to said skirt portion at about said end region by a plurality of frangible connectors, said band being connected to said closure and positioned in overlapping relation to at least a portion of said at least one tab to limit pivoting of said at least one tab when said band is connected to said skirt and overlying said portion of said at least one tab, said band being removable from said closure to permit pivoting said at least one tab and removal of said closure from the container.

9. The child resistant closure in accordance with claim 8 including two release tabs, said tabs being circumferentially, opposingly oriented relative to one another, and wherein said tamper-indicating band is positioned in overlapping relation to at least a portion of both said tabs.

10. The child resistant closure in accordance with claim 8 wherein said release tab includes a ratchet.

11. The child resistant closure in accordance with claim 8 wherein said closure includes a pivot portion integral with said release tab, said pivot portion defining said release tab pivoting axis.

12. The child resistant closure in accordance with claim 11 wherein said pivot portion is integral with said release tab.

13. The child resistant closure in accordance with claim 12 wherein said pivot portion is integral with said annular skirt portion.

* * * * *